United States Patent [19]

Nakamura

[11] Patent Number: 4,921,286

[45] Date of Patent: May 1, 1990

[54] LOCK DEVICE FOR USE OF VEHICLE DOORS

[76] Inventor: Shuji Nakamura, 4-3, Midoricho 3-chome, Utsunomiya-shi, Tochigi-ken, Japan

[21] Appl. No.: 329,609

[22] Filed: Mar. 28, 1989

[30] Foreign Application Priority Data

Mar. 28, 1988 [JP] Japan ..... 63-73841

[51] Int. Cl.[5] ..... E05C 3/26

[52] U.S. Cl. ..... 292/216; 292/DIG. 38

[58] Field of Search ..... 292/216, 280, DIG. 62, 292/DIG. 26, DIG. 27, 48, 201, DIG.38

[56] References Cited

U.S. PATENT DOCUMENTS 3,614,146 10/1971 Marx ..... 292/216

4,073,519 2/1978 Kurozu et al. ..... 292/216

4,334,704 6/1982 Yamada ..... 292/216

4,492,395 1/1985 Yamada ..... 292/216

*Primary Examiner*—Richard E. Moore

*Attorney, Agent, or Firm*—Browdy and Neimark

[57] ABSTRACT

A lock device for the use of vehicle doors in which a latch engaging a striker is supported to a lock body by a first shaft, a ratchet for preventing the latch form reversing and an open lever for releasing the engagement of the ratchet with the latch are supported to the lock body by a second shaft, and a lock lever for changing over the relation between the ratchet and the open lever to the engagement and to the disengagement is supported to the lock body by a third shaft, wherein a lock piece moving with the pivotal motion of the lock lever is supported to the second shaft. The lock device further includes a keyless lock mechanism, in which the operation of a sillknob alone cannot change over the lock device to the lock state.

6 Claims, 3 Drawing Sheets

LOCK DEVICE FOR USE OF VEHICLE DOORS

BACKGROUND OF THE INVENTION

1. Field of the Invention:

This invention relates to a lock device for the use of vehicle doors.

2. Description of the Prior Art:

As for a lock device for the use of vehicle doors, Patent Laid-open No. Sho 58-207468 well known per se has disclosed a vehicle door lock device, which comprises a lock body, a latch engaging a striker and supported to the lock body by a first shaft, a ratchet for preventing the latch from reversing, an open lever for releasing the engagement of the ratchet with the latch, said ratchet and said open lever being supported to the lock body by a second shaft, and a lock lever for changing over the relation between the ratchet and the open lever to the engagement and to the disengagement and supported to the lock body by a third shaft. When the ratchet and open lever are supported by the same shaft in this manner, the lock device may be manufactured in small size, and a satisfactory feeling of operation may be obtained.

However, in the well-known device as described above, a lock piece moving with the pivotal motion of the lock lever is supported to the ratchet by a fourth shaft.

SUMMARY OF THE INVENTION

It is an object of the present invention to provide a lock device for the use of vehicle doors, in which a ratchet, an open lever and a lock piece are supported by the same shaft.

It is another object of the present invention to provide a vehicle door lock device which further comprises a keyless lock mechanism, that is, a mechanism so structured that the operation of a sillknob alone cannot change over the lock device to the locked state while a door is open.

The above-mentioned and other objects and features of the invention will become apparent from the following detailed description taken in conjunction with the drawings which indicate an embodiment of the invention.

DETAILED DESCRIPTION OF THE PREFERRED EMBODIMENT

Figure 1:
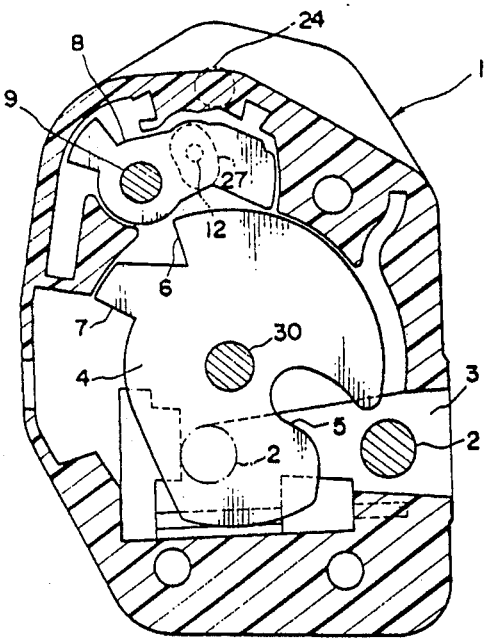
FIG. 1 is a cross-sectional front view showing a lock device according to the present invention.

In the drawings, reference numeral 1 designates a synthetic resin body of a lock device mounted on a door, 2 a striker fixedly attached to the side of a vehicle body. A latch 4 and a ratchet 8 are rotatably supported in the body 1 by shafts 30, 9. When the striker 2 proceeds to a striker groove 3 of the body 1, the striker 2 comes into engagement with an engagement groove 5 of the latch 4, while the ratchet 8 comes into engagement with a half-latch engagement portion 6 and a full-latch engagement portion 7 of the latch 4 in the mentioned order to thereby prevent the latch 4 from reversing.

Figure 2:
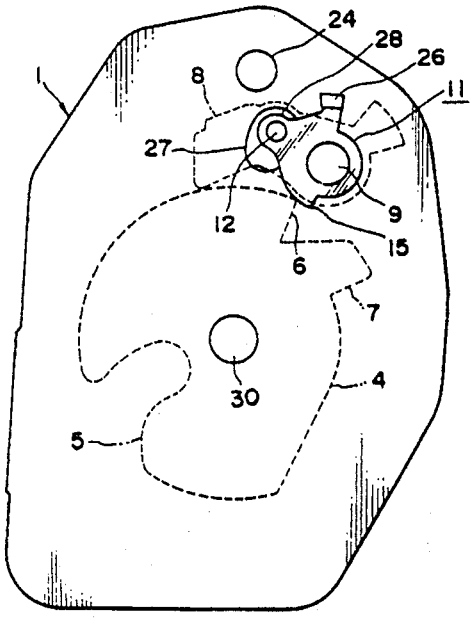
FIG. 2 is a back view showing the lock device, in which a release member is mounted on a body.
Figure 4:
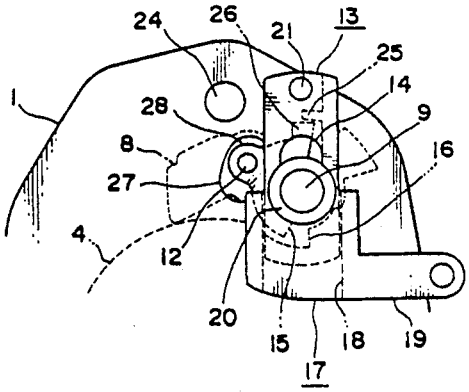
FIG. 4 is a view showing a state, in which the release member, lock piece and an open lever are fitted to the shaft.

A shaft 9 of the ratchet 8 extends through the body 1 to project out of the back side of the body and rotatably supports a release member 11 to a projection of the shaft 9 (See FIG. 2). The release member 11 has an engagement portion 15 and a projection 26 protruding toward the other side of the body 1 so as to be opposite to each other with the shaft 9 in between. The release member 11 also has an expanded portion 28 formed on the side of the shaft 9. The expanded portion 28 and ratchet 8 are fixed in position by a pin 12 through a long hole 27 of the body 1. As a result, when the release member 11 is rotated, the ratchet 8 rotates through the pin 12.

Figure 13:
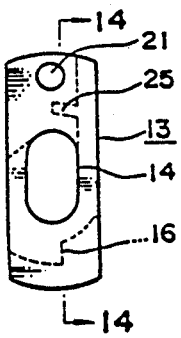
FIG. 13 id a plan view showing the lock piece.
Figure 14:
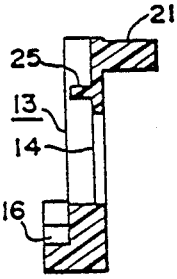
FIG. 14 is a sectional view taken along a line X—X in FIG. 13.

As shown in FIGS. 3 through 8, the shaft 9 protrudes rearwards farther from the release member 11 to thereby rotatably support a lock piece 13 and an open lever 17 in the mentioned order to the projection. As shown in FIGS. 13 and 14, the lock piece 13 is rectangular in shape and has a center formed with a longitudinally extending long hole 14, through which the shaft 9 is inserted. An engagement pawl 16 is formed at a lower portion of the lock piece 13 and when the lock piece 13 moves upward within the range of the long hole 14 (See FIG. 3), the pawl 16 of the lock piece 13 comes to be capable of being in egngagement with the engagement portion 15 of the release member 11 (unlocked state). In this state, when the lock piece 13 is rotated clockwise, the pawl 16 comes into engagement with the engagement portion 15, then the release member rotates clockwise and the ratchet 8 is released from the engagement with the latch 4. When the lock piece 13 is rotated clockwise while the lock piece 13 moves downward, the pawl 16 is out of engagement with the engagement portion 15, so that the release member 11 and ratchet 8 do not rotate (locked state).

Figure 3:
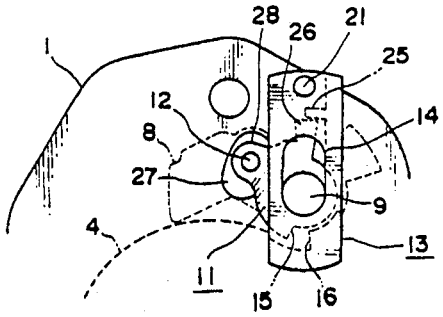
FIG. 3 is a view showing a state, in which the release member and a lock piece are fitted to a shaft.
Figure 7:
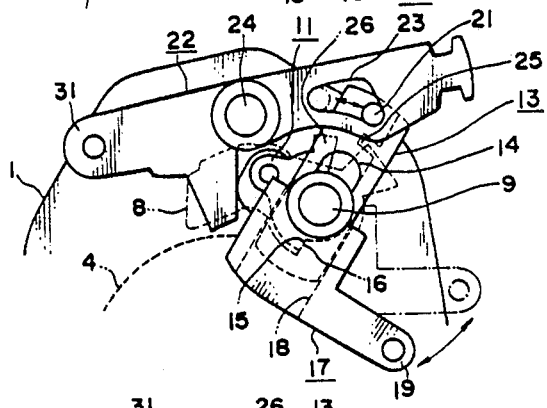
FIG. 7 is a view showing the case where an open lever is rotated when the door is open and the lock device is in the unlocked state.

An upward projecting pin 21 is formed on an upper portion of the lock piece 13 as being integral therewith. A keyless locking projection 25 is formed between the long hole 14 and the pin 21 on the inner surface of the lock piece 13. As shown in FIG. 3, when the latch 4 and ratchet 8 are out of engagement (door open state), the projection 25 confronts the projection 26 of the release member 11 to prevent the lock piece 13 from moving downward. However, when the lock piece 13 is rotated clockwise as shown in FIG. 7 while the door is open, the projection 25 moves to the side of the projection 26 to thereby permit the lock piece 13 to move downward. Therefore, in order to permit the lock device to be in a locked state when the door is open, the operation rotating the lock piece 13 is necessary, in addition to the operation of moving the lock piece 13 downward, so that it is possible to prevent a user from locking the door unconsciously with a key left inside the vehicle.

Figure 15:
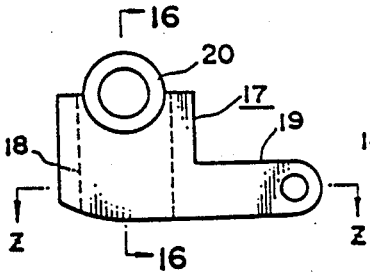
FIG. 15 is a plan view showing the open lever.
Figure 16:
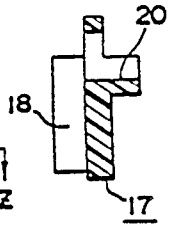
FIG. 16 is a sectional view taken along a line Y—Y in FIG. 15.
Figure 17:
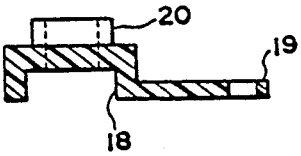
FIG. 17 is a sectional view taken along a line Z—Z in FIG. 15.
Figure 18:
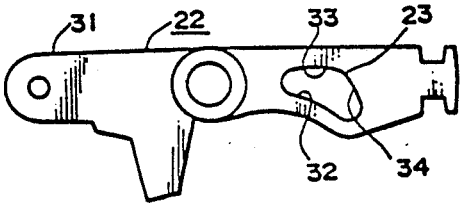
FIG. 18 is a plan view showing a lock lever.
Figure 19:
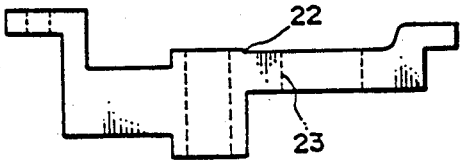
FIG. 19 is a side view showing the lock lever.

The open lever 17 is rotatably mounted on the shaft 9 by a shaft sleeve 20. As shown in FIGS. 15 through 17, a slide groove 18 is formed in the lower surface of the open lever 17 and the lock piece 13 is slidably fitted in the slide groove 18. Accordingly, when the open lever 17 rotates, the lock piece 13 also rotates through the engagement with the slide groove 18. An open handle (not shown) of a door is connected to a pivotal arm 19 of the open lever 17 through a rod.

Reference numeral 22 designates a lock lever rotatably supported to the body 1 by a shaft 24. The lock lever 22 is formed with a through hole 23, with which the pin 21 is in engagement. The through hole 23 is substantially triangular in shape and has a bottom 32 formed into an arcuate surface centering around the shaft 9 and having the length equal with the pivotal width of the pin 21, under the unlocked state (see FIGS. 5 through 7). A left inclined surface 33 of the through hole 23 is formed into an arcuate surface centering around the shaft 9 and having the length equal with the pivotal width of the pin 21, under the locked state (See FIG. 8). A right inclined surface 34 of the through hole may be at any form. A sillknob is connected to one end 31 of the lock lever 22 through a rod.

Figure 6:
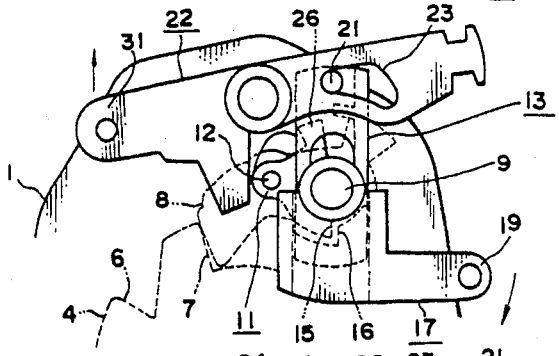
FIG. 6 is a view showing the unlocked state of the lock device when the door is closed.

OPERATION:

When the door is closed, the latch 4 on the door side comes into engagement with the striker 2 on the vehicle body side and the latch 4 rotates to bring the ratchet 8 into engagement with the full-latch engagement portion 7 of the latch 4, so that the operation of closing the door is complated (See FIG. 6).

Under the condition as shown in FIG. 6, when the open handle of the door is operated to rotate the open lever 17 clockwise, the lock piece 13 rotates about the shaft 9, the release member 11 rotates clockwise through the engagement of the pawl 16 with the engagement portion 15 and the ratchet 8 is released from the latch 4 through the pin 12 to thereby open the door. Further, at this time, since the pin 21 of the lock piece 13 only moves along the arcuate surface 32 of the through hole 23, the lock lever 22 does not pivot.

Figure 8:
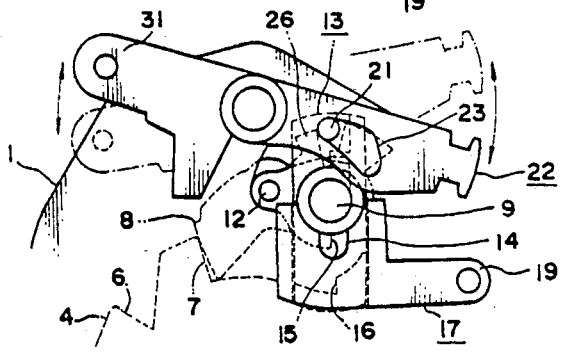
FIG. 8 is a view showing the locked state of the lock device when the door is closed.
Figure 9:
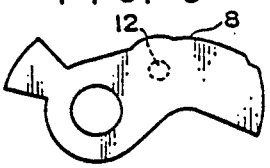
FIG. 9 is a plan view showing a ratchet.
Figure 10:
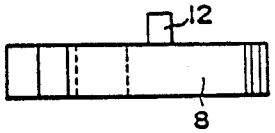
FIG. 10 is a side view showing the ratchet.
Figure 11:
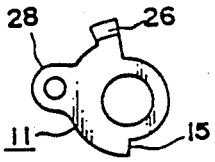
FIG. 11 is a plan view showing the release member.
Figure 12:
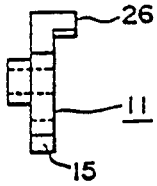
FIG. 12 is a side view showing the release member.

In FIG. 6, when the locking operation is done by pressing down the sillknob, the lock lever 22 rotates clockwise to reach a position indicated by a solid line in FIG. 8 and the lock piece 13 is pressed down along the groove 18 of the open lever 17 through the engagement of the inclined surface 33 of the through hole 23 with the pin 21, so that the confrontation between the pawl 16 and the engagement portion 15 is released. In consequence, even if the open lever 17 is rotated clockwise, the pawl 16 does not come into engagement with the engagement portion 15, and the ratchet 8 does not pivot. Further, since the pin 21 of the lock piece 13 moves along the inclined surface 33 of the through hole 23, the lock lever 22 does not pivot either.

In FIG. 8, when the sillknob is pulled to return the lock lever 22 to the position shown in FIG. 6, the lock piece 13 is raised upwards through the engagement of the arcuate surface 32 of the through hole 23 with the pin 21, so that the pawl 16 confronts the engagement portion 15 (unlocked state).

Figure 5:
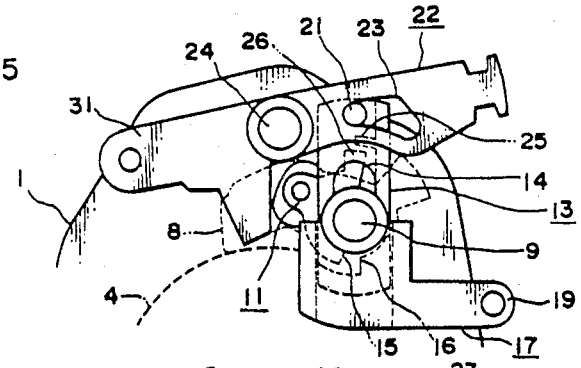
FIG. 5 is a view showing an unlocked state of the lock device when a door is open.

FIG. 5 shows the state in which the latch 4 is out of engagement with the ratchet 8 (door is open). In this state, when the locking operation is done by pressing down the sillknob, the lock lever 22 rotates clockwise and the lock piece 13 is to be pressed down along the groove 18 of the open lever 17 through the engagement of the inclined surface 33 of the through hole 23 with the pin 21. However, since the projection 26 of the release member 11 confronts the projection 25 of the lock piece 13, the lock piece 13 does not move downwards, so that the locking operation cannot be done. Accordingly, when the door is open, the lock device is not changed over to the locked state even by pressing down the sillknob unconsciously to thereby prevent a user from locking the door with the key left inside the vehicle.

When the lock device is changed over to the locked state by the operation of the sillknob while the door is open, the open handle of the door is operated, as shown in FIG. 7, to rotate the open lever 17 and lock piece 13 clockwise and the projections 26 and 25 are released from confronting each other. In this state, when the locking operation is done by pressing down the sillknob, the lock lever 22 rotates clockwise to press down the clock piece 13 along the groove 18 of the open lever 17 through the engagement of the inclined surface 33 of the through hole 23 with the pin 21.

What is claimed is:

1. A lock device for the use of vehicle doors, including a lock body, a latch engaging a striker and supported to said lock body by a first shaft, a ratchet for preventing said latch from reversing, an open lever for releasing the engagement of said ratchet with said latch, said ratchet and said open lever being supported to said lock body by a second shaft, and a lock lever for changing over the relation between said ratchet and said open lever to the engagement and to the disengagement and supported to said lock body by a third shaft, characterized by supporting a lock piece, which moves with the pivotal motion of said lock lever, to said second shaft.

2. A lock device for the use of vehicle doors according to claim 1, wherein said lock piece is provided with a long hole, whereby said second shaft is inserted through said long hole to permit said lock piece to be slidable.

3. A lock device for the use of vehicle doors according to claim 2, wherein said lock piece is further provided with a first projection, whereby the relation between said first projection and said ratchet is changed over to the engagement and to the disengagement when said lock piece slides.

4. A lock device for the use of vehicle doors according to claim 3, wherein said lock piece is further provided with a second projection, whereby said second projection comes into engagement with said ratchet to prevent said lock piece from sliding to be in said disengagement when the door is open.

5. A lock device for the use of vehicle doors, comprising:

a latch supported to the front surface of a synthetic resin body by a first shaft and engaging a striker;

a ratchet supported to the front side of said synthetic resin body by a second shaft and preventing said latch from reversing:

a release member supported to a projection of said second shaft on the back surface of said synthetic resin body, fixed to said ratchet through a pin, and including a first engagement portion;

a lock piece supported to the projection of said second shaft on the back surface so as to be slidable through a long hole, and including a first projection movable from a position where said first projection is capable of being in engagement with said first engagement portion through the sliding of the lock piece to a position where said first projection misses said first engagement portion;

an open lever supported to the projection of said second shaft on the back surface and including a groove fitted therein to said lock piece so as to be only capable of sliding; and a lock lever supported to the back surface of said synthetic resin body by a third shaft and permitting said lock piece to slide.

6. A lock device for the use of vehicle doors, according to claim 5, wherein said release member further includes a second engagement portion, and said lock piece further includes a second projection which is in engagement with said second engagement portion when the door is open while being out of engagement with said second engagement portion when the door is closed.

* * * * *